US005671596A

United States Patent [19]

Mack et al.

[11] Patent Number: 5,671,596

[45] Date of Patent: Sep. 30, 1997

[54] BOBBIN AND CORE SLEEVE TRANSPORT SYSTEM FOR A ROVING FRAME

[75] Inventors: Karl-Heinz Mack, Weilheim; Karl-Heinz Zettler, Reutlingen; Hans-Peter Weeger, Hattenhofen, all of Germany

[73] Assignee: Zinser Textilmaschinen GmbH, Ebersbach/Fils, Germany

[21] Appl. No.: 573,378

[22] Filed: Dec. 15, 1995

[30] Foreign Application Priority Data

| | | | |
|---|---|---|---|
| Dec. 19, 1994 | [DE] | Germany | 44 45 263.2 |
| Dec. 19, 1994 | [DE] | Germany | 44 45 264.0 |
| Dec. 19, 1994 | [DE] | Germany | 44 45 265.9 |

[51] Int. Cl.[6] ..... D01H 9/10; D01H 9/14

[52] U.S. Cl. ..... 57/281; 57/67; 57/90; 57/266; 57/267; 57/268; 57/270; 57/273

[58] Field of Search ..... 57/67, 90, 266, 57/267, 268, 270, 273, 281

[56] References Cited

U.S. PATENT DOCUMENTS

| | | | |
|---|---|---|---|
| 3,935,699 | 2/1976 | Iida et al. | 57/267 |
| 4,841,719 | 6/1989 | Sasaki et al. | 57/267 |
| 4,888,946 | 12/1989 | Marzioli | 57/267 |
| 4,999,988 | 3/1991 | Roder et al. | 57/90 |
| 5,010,725 | 4/1991 | Yasui et al. | 57/90 |
| 5,172,541 | 12/1992 | Schmalz | 57/90 |
| 5,365,728 | 11/1994 | Mack | 57/90 |
| 5,375,405 | 12/1994 | Weeger | 57/90 |

FOREIGN PATENT DOCUMENTS

| | | | |
|---|---|---|---|
| 314 631 | 5/1989 | European Pat. Off. . | |
| 2 227 105 | 12/1973 | Germany . | |
| 36 01 832 | 7/1987 | Germany . | |
| 42 13 122 | 10/1993 | Germany . | |
| 42 29 296 | 3/1994 | Germany . | |
| 43 13 024 | 10/1994 | Germany . | |
| 4-352824 | 12/1992 | Japan | 57/267 |

*Primary Examiner*—William Stryjewski
*Attorney, Agent, or Firm*—Herbert Dubno

[57] ABSTRACT

A roving frame having a suspension carriage track extending through the flyers thereof has a parking rail which can accommodate the full length of the suspension carriage train which removes the full bobbins from the flyer row and on the parking rail, by cooperation with a stationary bobbin/sleeve exchanger or one movable along the parking track, can transfer the full bobbins to a transport track and mount empty core sleeves on the suspension carriage train.

19 Claims, 11 Drawing Sheets

11
24
25
6
22
1
2
8
7
5
4
3
25
26

11
24
25
6
22
72
7
2
8
25
4
71
3
9

BOBBIN AND CORE SLEEVE TRANSPORT SYSTEM FOR A ROVING FRAME

SPECIFICATION

FIELD OP THE INVENTION

The invention relates to a transport and replacement system for bobbins and core sleeves for a roving frame and particularly for a roving frame having at least one row of flyers along which a suspension carriage track is provided.

BRIEF DESCRIPTION OF THE INVENTION

A transport system utilizing suspension carriage trains is described in DE 42 29 296 A1 corresponding to U.S. Pat. No. 5,375,405. To replace full bobbins with empty core sleeves on the roving frame, a suspension carriage track is provided through the row of flyers. On this track, carriages are displaced in a train and bring empty core sleeves above the empty bobbin spindles and provide seats upon which the full bobbins can be mounted so that the full bobbins can be carried off by the suspension carriage train. The transfer of the full bobbins to the train is effected by lifting the spindle rail. Hangers from the suspension carriage engage the full bobbins and the suspension carriages can then be moved by half the pitch of the spindles on the spindle rail whereupon the spindle rail can be lifted again to receive the empty sleeves.

The suspension carriage train can carry the full bobbins out of the flyer row whereupon the flyer operation can begin again and sliver from sliver cans can be wound as roving on the bobbins.

It will be clear that, in this earlier system, the suspension carriage train carrying the empty core sleeves is displaced into the region of the flyers for the bobbin change procedure and is displaced out of the flyer region with the full bobbins thereon at the conclusion thereof. The full bobbin sleeves must be processed further, e.g. by spinning to yarn or thread, in a ring-spinning frame.

OBJECTS OF THE INVENTION

It is the principal object of the present invention to provide an improved mechanism for the transfer of full bobbins and core sleeves relative to a roving frame whereby drawbacks of earlier systems are obviated.

Another object of the invention is to provide an improved bobbin travel or transport system which will increase the overall bobbin change speed and reduce the down time of a roving frame.

SUMMARY OF THE INVENTION

These objects and others which will become apparent hereinafter are attained, in accordance with the invention, by providing a parking track for the or each suspension carriage track and located outside the region of the flyers, these parking tracks being at least as long as the suspension carriage track in the region of the flyers so as to be able to accommodate the full length of the respective suspension carriage trains.

This allows the suspension carriage train on a parking track in the immediate vicinity of the flyer region but outside the flyer row itself to be displaced from the parking track onto the suspension carriage track in the flyer row in a very brief period of time and also ensures that the bobbin chain with the full bobbins thereon can rapidly be displaced onto the parking tracks to minimize the delay in removal of the full bobbins from the region of the flyers. As a consequence, the duration of the bobbin change process can be greatly reduced and the down time of the machine diminished. Furthermore, there is no need for increasing the lengths of the suspension carriage track so that it can retain the train of suspension carriages outside the flyer regions.

There are transport and bobbin-change systems known (EP 0 314 631 and DE 42 29 296) wherein full bobbins and empty sleeves are exchanged between the roving frame and a suspension track which extends along the roving frame. Since this suspension track does not extend through the region of the flyers, there is no need for the suspension carriage train at the end of the change process to be removed from this track. The track can extend directly to a replacement station (at which the full bobbins are removed and replaced by core sleeves) or to the ring-spinning machines (at which the roving is spun into yarn).

These systems, however, have no parking tracks in the sense of the present invention.

The parking tracks of the invention allow the full bobbins to be carried rapidly out of the machine and stored temporarily in the parking tracks on the suspension carriage train. The bobbins can be removed from the suspension carriages, e.g. by hand, and replaced with empty core sleeves.

While hand operation is possible, it has been found to be advantageous to pass a suspension carriage train through a changing station or device or to pass a changing device along the suspension carriage train for removing the full bobbins and replacing them on the train with empty core sleeves. The suspension track can receive the bobbins from the change-over device and thus may have a section passing through the latter or along which the change-over device is provided. The suspension track which carries the bobbins to the ring-spinning machines can, if desired, be provided with suspension carriages as well or with an endless chain from which hangers depend.

When reference is made herein to a storage region, it will be understood that we refer to a region spaced from the roving frame into which the transport track can carry the full bobbins to store them until further handling is required, e.g. by spinning in a ring-spinning frame. A processing region is, therefore, a region which can comprise a number of ring-spinning frames in which the roving can be spun to yarn and thus removed from the full bobbins to generate the empty core sleeves which are returned by the transport track to the roving frame.

When reference is made herein to a bobbin/sleeve exchange station, it will be understood that we intend to define thereby a device which can effect automatic removal of full bobbins from the suspension carriage train and transfer those full bobbins to the transport track, while placing empty core sleeves, usually from the transport track, on the hangers of the suspension carriage train.

According to a feature of the invention, the bobbin/sleeve exchange station can be displaceable along the parking track. In that case, the transport track segment may also extend along the parking track and can be of a length corresponding to the length of the parking track or at least to the length of the suspension carriage train thereon. On this segment, the bobbin/sleeve exchange device can transfer full bobbins from the suspension carriage train on the parking track to the transport means of the transport track, e.g. a carriage train thereon or an endless chain with hangers for such full bobbins. In this case, the bobbin/sleeve exchanger need not shuttle between the bobbin/sleeve exchange station along the parking track and a bobbin/sleeve exchange station of the transport track.

To enable unhindered in and out movement of the suspension carriage train, each suspension carriage track can be provided with a respective parking track. The combination of the suspension carriage track and the parking track connected thereto can form a closed ring if desired.

According to another feature of the invention, at least one of the parking tracks can be provided with a shuttle track which can join the parking track at a transition region at which a stationary bobbin/sleeve exchange station can be provided. In this case, the exchange station can be fixed in position and carries out the bobbin/sleeve transfer as the suspension carriage train is displaced from the parking track onto the shuttle track.

Each parking track can have its own shuttle track although it is advantageous and preferred to provide only one shuttle track for both of the parking tracks and to connect at least one of the parking tracks to the shuttle track via a branch track segment.

The suspension carriage track and its respective parking track can form a closed ring, in which case a crossover and branch track may be necessary to enable each ring to transfer the respective suspension carriage train to the shuttle track.

It has been found to be advantageous, moreover, to provide the at least one parking track or both parking tracks so that they form stretches of an elongated closed loop track to which the suspension carriage tracks may be connected by branch track segments. The branch track segments may automatically return to normal positions if the suspension carriage train travels over the branch track segment in a non-normal position of the latter or the branch track segments can be controlled switch tracks.

The bobbin and core sleeve transport system of the invention thus can comprise:

- a roving frame formed with a flyer region having at least one row of flyers;
- a suspension carriage track extending through the row of flyers;
- a suspension carriage train displaceable along the suspension carriage track and provided with hangers receiving full bobbins from the roving frame and carrying empty core sleeves to the roving frame; and
- a parking track connected to the suspension carriage track at least at one end thereof and of a length sufficient to accommodate a full length of the suspension carriage train.

Advantageously that system includes:

- a transport track from which the full bobbins and empty core sleeves can be suspended and having a track segment proximal to the parking track;
- a bobbin/sleeve exchange station coupling the transport track with the parking track to transfer full bobbins from the suspension carriage train while parked on the parking track to the transport track and empty core sleeves from the transport track to the suspension carriage train parked on the parking track; and
- means spaced from the roving frame and to which the transport track extends for receiving full bobbins from the transport track.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
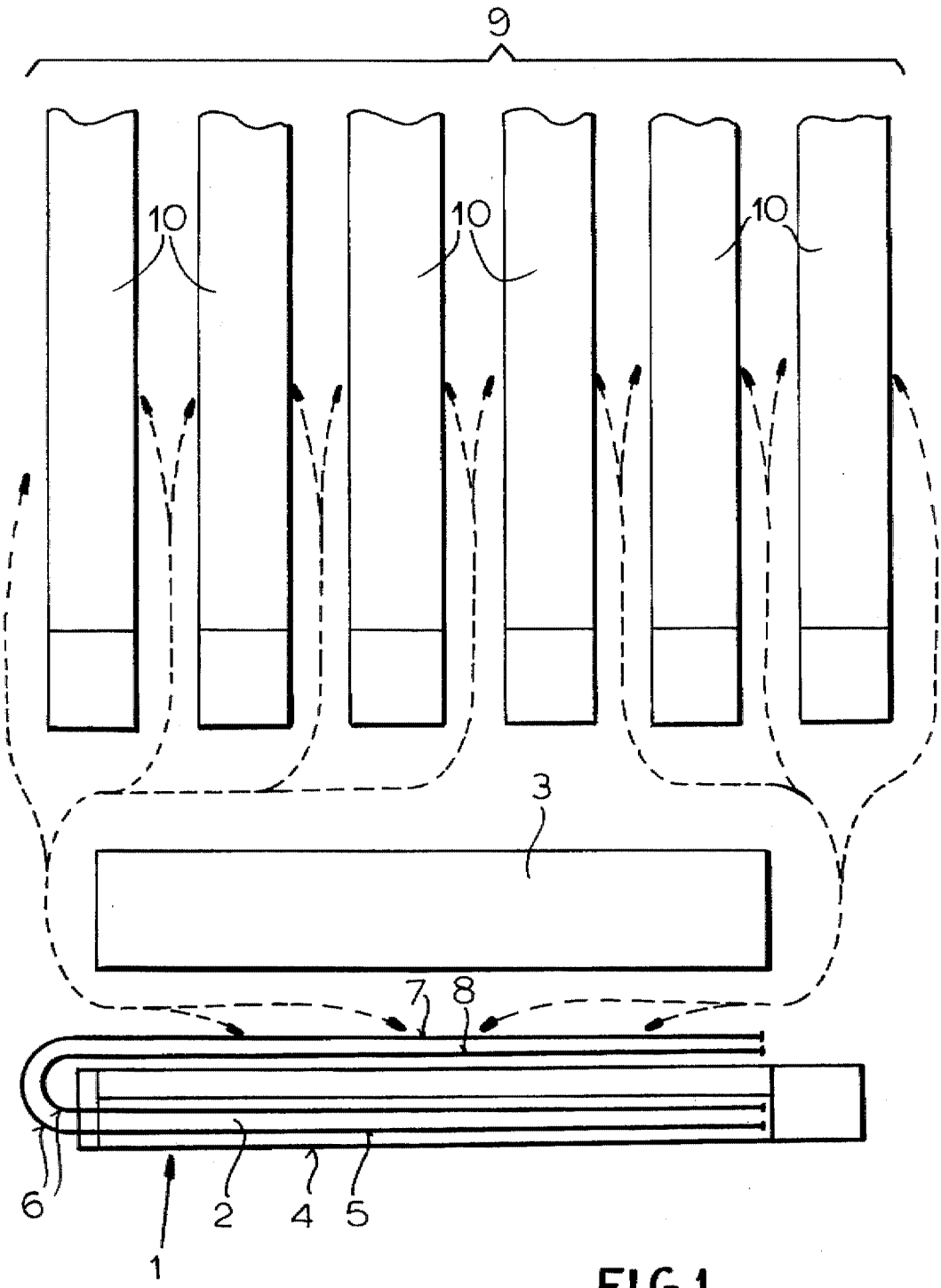
FIG. 1 is a plan view illustrating principles of the present invention.

FIG. 1 is a plan view illustrating the principles of the invention for a roving frame i with two rows of flyers on a side of that roving frame and a can region 3 receiving the sliver cans which feed the roving frame 1. The flyer region of the roving frame is represented at 2 and will have two rows of flyers (not shown) with each of the flyer rows provided with a suspension carriage track 4, 5 which can run through the flyers of the respective track as described in DE 42 29 296 A1, for example, see also U.S. Pat. No. 5,375,405. The apparatus includes, as described in the latter patent, means for automatically replacing full bobbins on the respective spindles associated with the flyers with bobbin core sleeves (empty sleeves or bobbins) delivered by the suspension carriage train displaceable along the rails 4, 5 so that the respective trains can carry away the full bobbins.

The system for effecting such bobbin change and the manner in which the rails 4, 5 are accommodated by the flyers will be fully apparent from the aforementioned patents.

The tracks 4 and 5 comprise rails from which the respective carriages receiving the core sleeves and the bobbins by hangers from these carriages, are suspended. The carriages are articulated together to form the respective trains and each trains can be controllably driven by a friction wheel drive or the like as is known from the aforementioned patents and the art generally.

Figure 5:
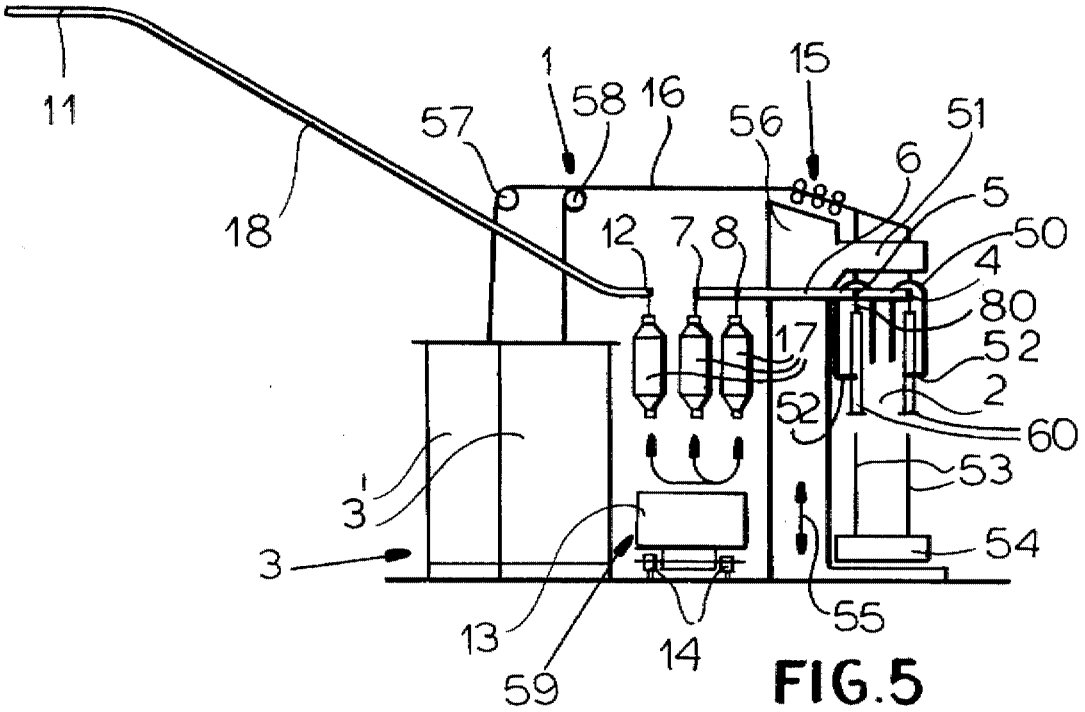
FIG. 5 is a cross sectional view in a plane perpendicular to the flyer rows illustrating a bobbin and core sleeve transport system in which the transport track segment is located beneath the sliver passing from the can field to the roving frame.

The full bobbins and empty core sleeves can be removably engaged by the hangers 80 (representing the trains and carriages as well) in FIG. 5 extending downwardly from the respective carriages.

In accordance with the principles of this invention, each of the suspension carriage rails 4, 5 is connected by a respective connecting stretch 6 to a respective parking rail or track 7, 8 behind the roving frame 1. These parking tracks or rails 7, 8 are of a sufficient length that they can receive the full lengths of the suspension carriage trains carrying the empty sleeves into the roving frame and receiving the full bobbins therefrom.

As a consequence, at each bobbin replacement stage of the roving frame, a suspension carriage train previously supplied with empty bobbins, i.e. core sleeves and parked on the respective track 7 or 8, can be fed rapidly into the flyer regions 2 of the roving frame, can receive the full bobbins on alternate hangers of this train, can transfer empty bobbins or core sleeves to the spindles from which the full bobbins were extracted, and can then be displaced back onto the respective parking track 7, 8 at high speed. Unproductive down time of the roving frame for a bobbin replacement is thus very brief.

While on the parking track, the full bobbins can be removed and empty core sleeves mounted on the suspension carriage train. In the simplest embodiment, this can be carried out by hand whereby the full bobbins can be placed in bobbin carriages and fed along the paths represented by the arrows to a further processing stage 9 which can comprise a multiplicity of ring-spinning machines 10. The ring-spinning machines, of course, spin the roving from the bobbins into yarn and return empty sleeves as indicated by the broken lines to the roving frame 1.

The processing region 9 is provided with a suspension track in which suspension carriage trains can be displaced or along which endless suspension chains can be displaced.

As will be described below in connection with FIG. 7, this suspension track 11 can be provided for the ring-spinning frames 10. The suspension track 11 extends substantially to the region of the roving frame 1 and is there coupled via a replacement station with the suspension track system 4–8 of the roving frame 1 for replacement of full bobbins with core sleeves.

Figure 2:
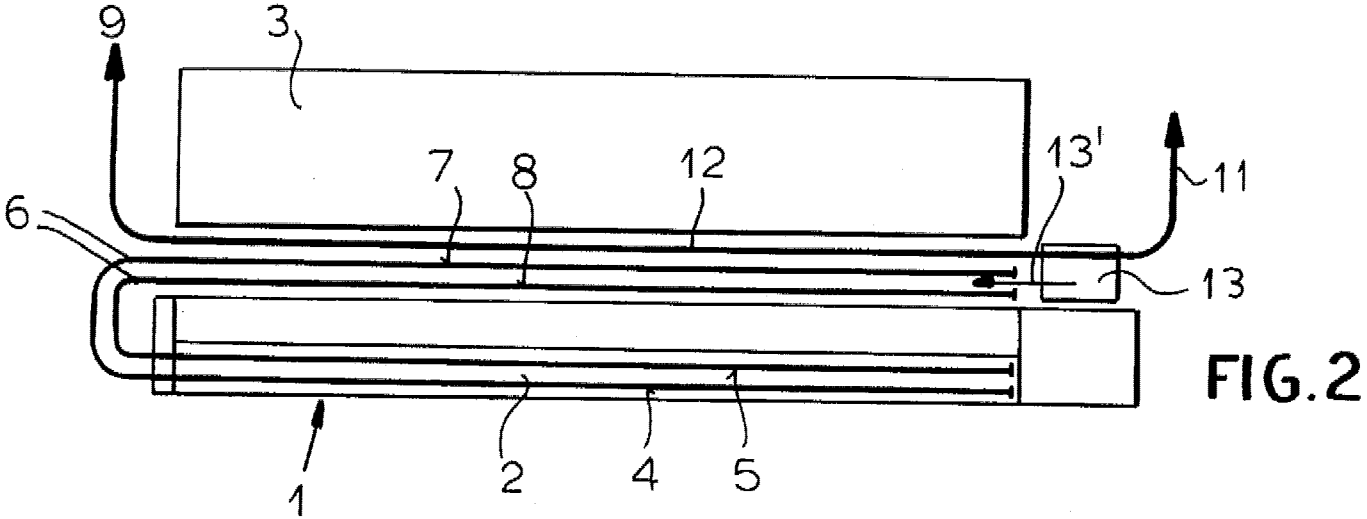
FIG. 2 is a plan view corresponding to a portion of FIG. 1 showing one embodiment of a parking track arrangement in association with a transport track segment.

As will be apparent from FIG. 2, a portion 12 of the suspension track 11 (serving the further processing operations at 9, 10) can extend parallel to the parking tracks 7, 8 and over a length at least equal to that of a suspension carriage train receivable on the respective parking track. A mobile bobbin change device represented diagrammatically at 13 is displaceable as represented by the arrow 13' along the parallel tracks 7, 8, 12 to transfer full bobbins from the suspension carriage trains on the parking track 7, 8 to the suspension carriages or suspension chain of the track segment 12 and to transfer empty bobbin cores or sleeves from the suspension carriages or chain, of track 12 to the suspension carriages of the trains of tracks 7 and 8.

Figure 6:
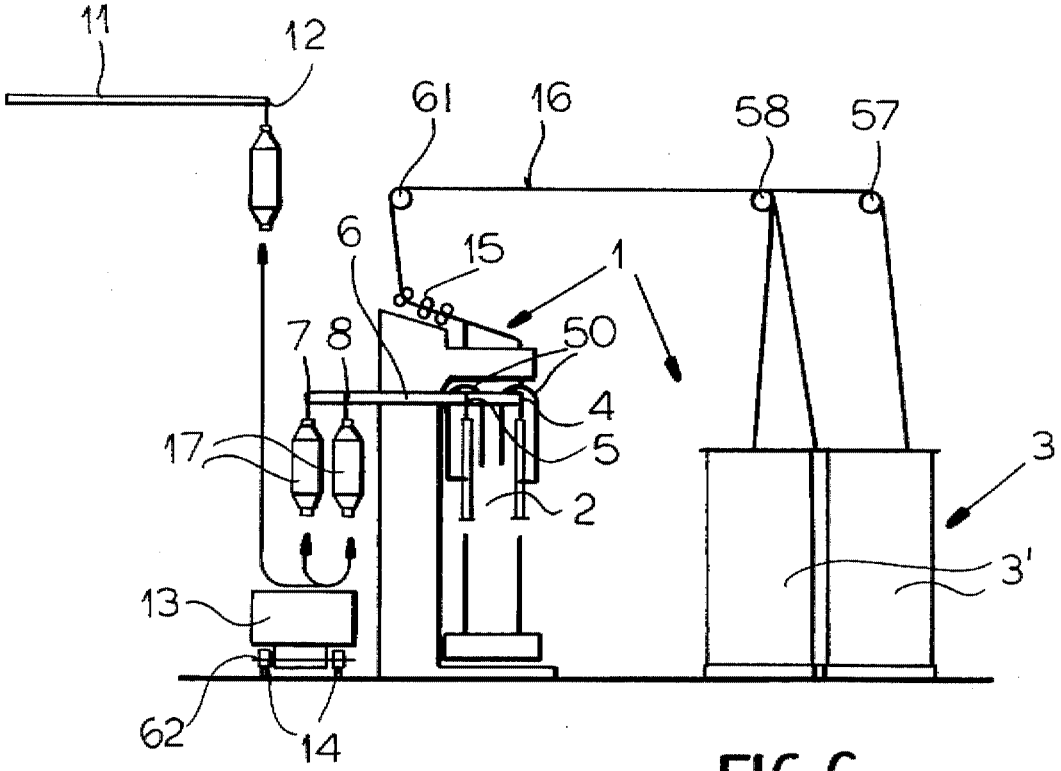
FIG. 6 is a view similar to FIG. 5 but showing an arrangement in which the can field is on the opposite side of the roving frame from the transport track.

The change-over unit 13 is displaced along a guide rail or runs on the rails 14 which have been illustrated in FIGS. 5 and 6.

Figure 3:
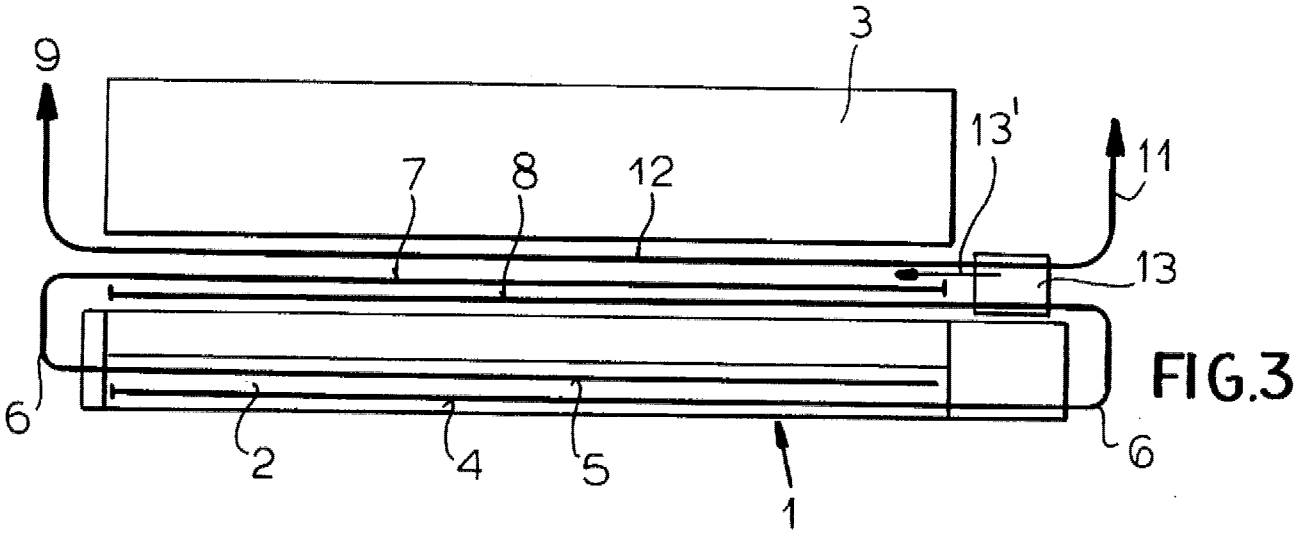
FIG. 3 is a view similar to FIG. 2 of a variant of this system.

While in the embodiments of FIGS. 1 and 2, the suspension carriage tracks 4, 5 and their parking tracks 7, 8 extend in the same sense around the roving frame 1, in the embodiment of FIG. 3, these tracks extend in opposite senses, but nevertheless are serviced by the displacement of the change-over unit 13 in the direction of the arrow 13' along the track segments 7, 8, 12.

Figure 4:
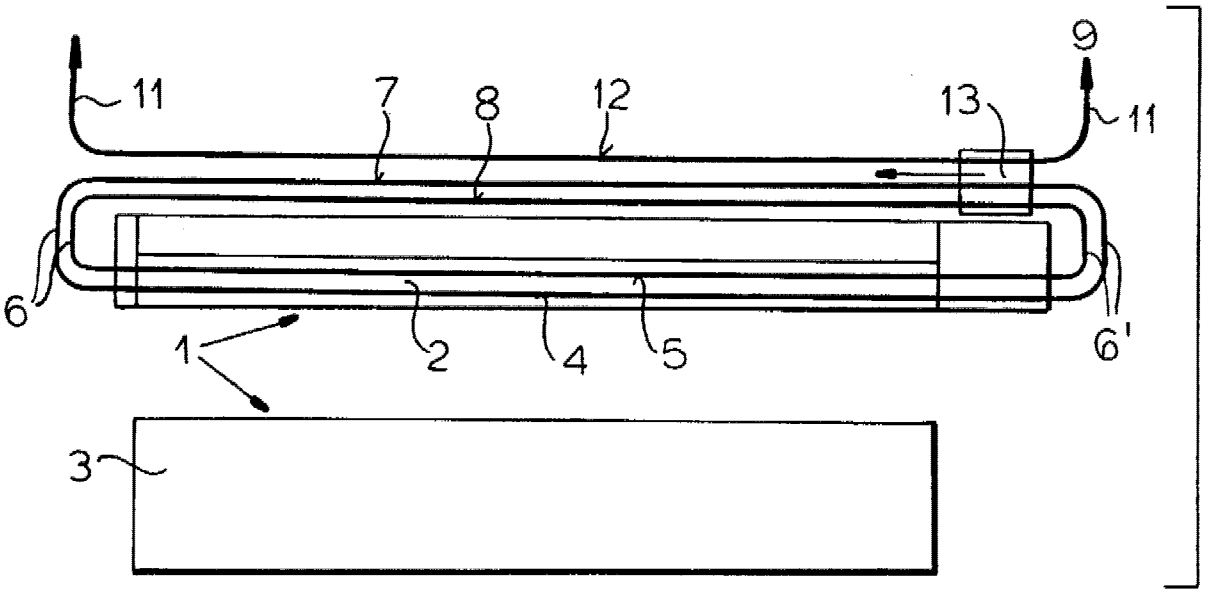
FIG. 4 is another view similar to FIG. 2 and representing a variant thereof.

In many cases it is also advantageous to form the suspension carriage tracks 4, 5 and the parking tracks 7 and 8 15 connected therewith as closed tracks as has been illustrated in FIG. 4. In this case, the suspension carriage trains are displaced along the respective tracks 4, 7 or 5, 8 always in the same direction through the respective row of flyers. This has the advantage of minimizing the chance of collision with pressing fingers of the flyers which may happen to be inwardly swung by especially the full bobbins during the bobbin replacement operation. Such annular closed tracks afford the further advantage that the suspension carriage trains can be subdivided at their middles into two halves. In that case one half can be displaced to the left while the other half can be displaced to the right into and out of the respective row of flyers which substantially shorten the time required for the introduction and removal of the respective suspension carriage train from the flyer region.

During a bobbin replacement for the roving frame 1, suspension carriage trains which have been previously prepared with empty core sleeves on the parking tracks 7, 8, are displaced from these parking tracks via the connected stretches 6 and 6' (FIG. 4) into the bobbin replacement position within the flyers. After replacement of the full bobbins for the empty sleeves (see DE 42 29 296 and U.S. Pat. No. 5,375,405), the suspension carriage trains from the tracks 4 and 5 are returned to the parking tracks 7, 8. The roving frame is returned to operation. During the operation of the roving frame to wind full bobbins on the core sleeves, the replacement unit 13 is displaced along the track segments 7, 8, 12 to remove the full bobbins from the suspension carriage trains and transfer them to the track 11 for delivery to the storage or processing region 9 which is equipped, for example, with the ring-spinning machine 10. The unit 13 also mounts core sleeves returned from the spinning frames 10 to the suspension carriage trains on the tracks 7, 8.

As can be seen from FIG. 5, the sliver 16 in the form of fiber bands, is withdrawn from the cans 3' in the can region 3 and fed via the drafting frame 15 of the roving frame 1 to the respective flyers 50 which are rotatable about vertical axes on the flyer rail 51 and can have fingers 52 which can be swung inwardly to press the roving against the bobbin as it is wound. Each of the flyers is juxtaposed with a respective spindle 53 on the spindle rail 54 which can be raised and lowered as represented by the arrow 55. The flyer rail 51 is mounted on the supports 56 of the flyer frame which also carries the drafting frame 15.

In the embodiment shown in FIG. 5, the sliver 16 passes via guide rails 57, 58 over the region 59 in which the change-over device 13 is provided and which changes the full bobbins 17 for the empty core sleeves 60 between the parking tracks 7, 8 and the suspension track 11 whose segment 12 is lower than the customary height of the balance of the track 11 and thus is connected thereto by ramps 18 (one shown) at opposite ends of the segment 12 which runs perpendicular to the plane of the paper in FIG. 5. The suspension carriage trains or suspension chain displaceable along the track system 11, 18, 12 must thus be flexible in the vertical direction as well as along the length of that train or chain.

Alternatively, the can region 3 (FIGS. 4 and 6) can be located in front of the roving frame 1 rather than behind it. In this case, the roving 16 is retracted by the roller 61 to pass through the drafting frame 15 from the rear. The replacement device 13 for the exchange of full bobbins 17 and core sleeves with the track 11 can be located behind the roving frame. In this case, the track 11 need not extend downwardly into the region of the tracks 7 and 8 and can remain at a higher level with the device 13 serving to deliver the full bobbins to the track segment 12 and receiving the core sleeves therefrom. In general the higher level represented in FIG. 6 is that which is desirable for the track 11 in the storage or processing region 9.

The replacement device can comprise, for example, two rotary gripping arms which can remove the bobbins from two parallel rows and place them in one row for transfer to the track segment 12 and for mounting empty cores on the suspension carriage train as, for example, described in DE 43 13 024.

Figure 7:
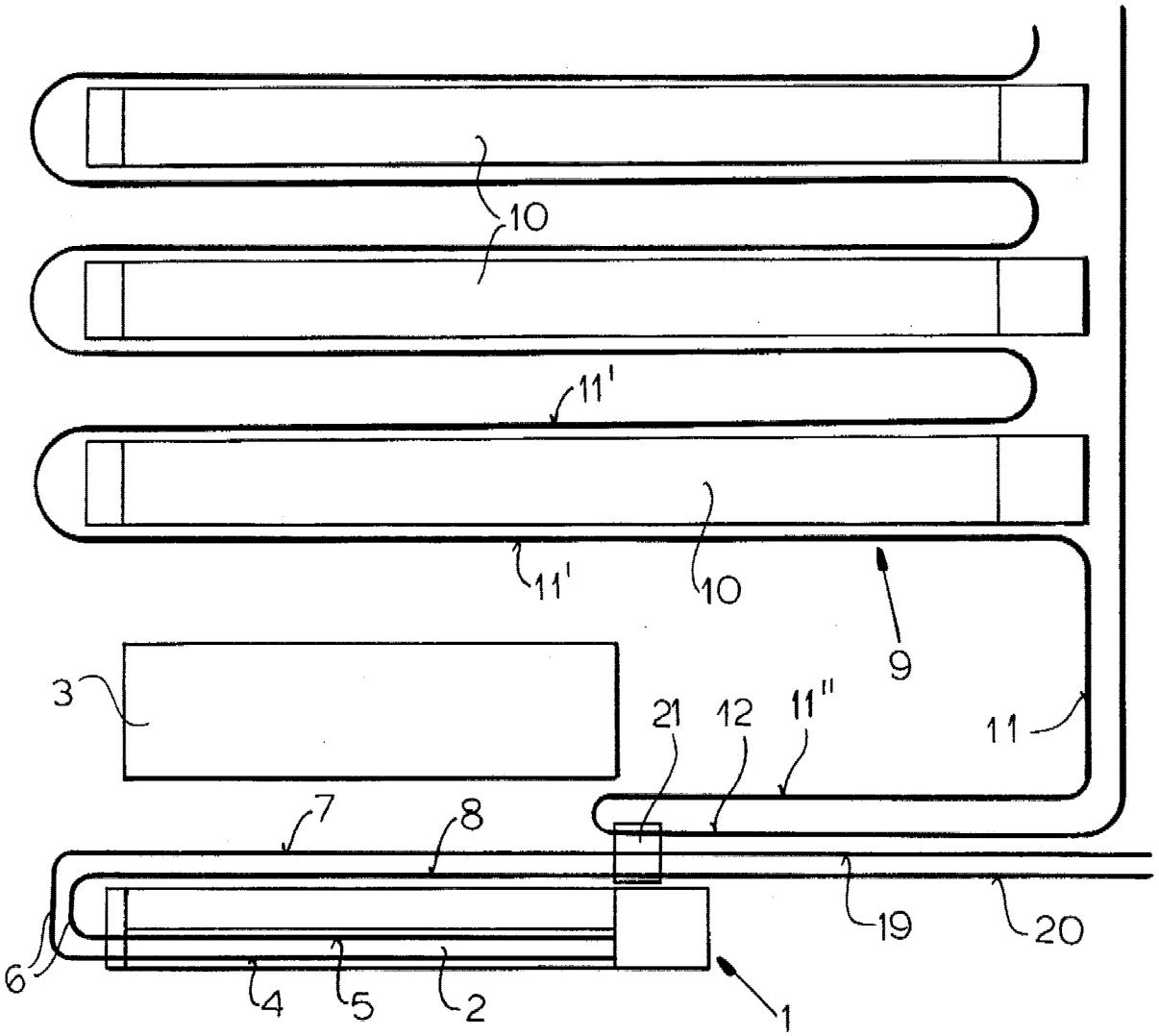
FIG. 7 is a view similar to FIG. 2 but showing a system in which the exchange station is stationary.

FIG. 7 is a partial plan view of a spinning plant with a roving frame 1 and a processing region 9 provided with a multiplicity of ring-spinning machines 10 which are supplied with full bobbins from the roving frame 1. Only three of the ring-spinning frames 10 have been shown. Along the longitudinal sides of the ring-spinning frames 10, extend respective stretches 11' of the endless suspension track 11 which also extends to the region of the roving frame 1 and particularly to the region of the change-over station 21. In this case, the change-over station 21 is a stationary unit.

Also passing through the station 21 are shuttle tracks or extensions 19 or 20 of the parking tracks 7, 8 which are connected via the connecting stretches 6 with the tracks 4, 5 which extend through the flyer rows of the flyer region 2 of the roving frame 1.

To replace full bobbins on the suspension carriage trains at the parking tracks 7, 8 for empty bobbins form the stretch 11" of the track 11 and the suspension carriages or chain thereof, the suspension carriage trains are displaced form the parking track 7, 8 through the station 21 and back to their original positions on the parking track. The extensions 19 and 20 thus allow the shuttling of the suspension carriage trains through the unit 21. The full bobbins are carried by the track 11 to the ring-spinning frames 10 as previously described.

Figure 8:
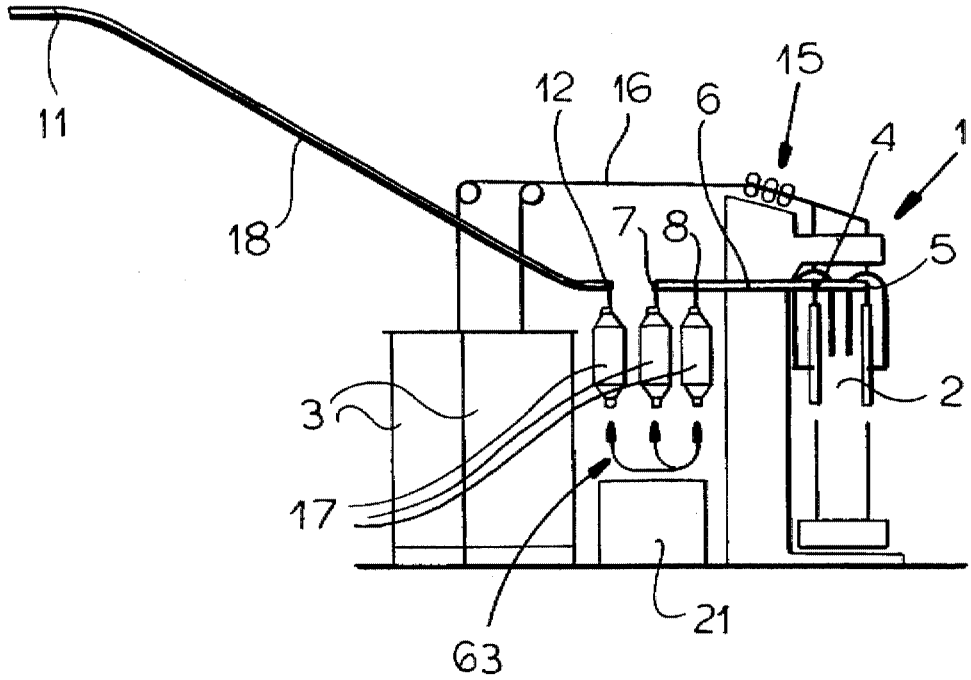
FIG. 8 is a view similar to FIG. 5 pertinent to the embodiment of FIG. 7.

From FIG. 8 it will be apparent that the change-over device 21 need not roll on the rails as is the case in the embodiments of FIGS. 5 and 6 in which the change-over device 13 has wheels 62 which ride on the tracks 14 parallel to the track segments 7, 8, 12. The mechanism for removing the full bobbins 17 from the suspension carriage trains as they are displaced form tracks 7 and 8 onto the tracks 19 and 20, transferring these full bobbins to a track segment 12 traversing the station 21 and forming part of the track 11 and for delivering empty core sleeves from the track segment of the loop 11' to the hangers of the suspension carriage trains has been represented at 63 by arrows.

Figure 9:
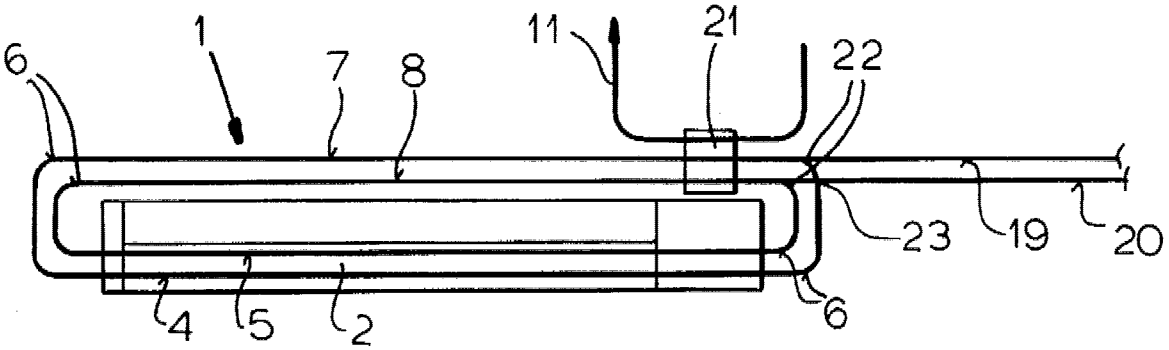
FIGS. 9–14 are plan views illustrating other track arrangements in accordance with the invention.

FIG. 9 illustrates an embodiment in which, in addition to having the extensions or shuttle tracks 19 and 20, the parking tracks 7, 8 can be closed by switching tracks 22 and can have a cross-over track 23. The change-over station 21 is here located in the region of the parking track 7, 8 or in the region of the shuttle tracks 19, 20. In this case, if desired, the suspension carriage trains can be displaced in the manner which has been described in connection with FIG. 4 when the branching tracks 22 so permit or can be operated in the manner described in FIGS. 7 and 8 when the branching tracks 22 do not close the path for the suspension carriage train. As in the embodiment of FIGS. 7 and 8, the change-over unit 21 can be a three-row change-over device.

Figure 10:
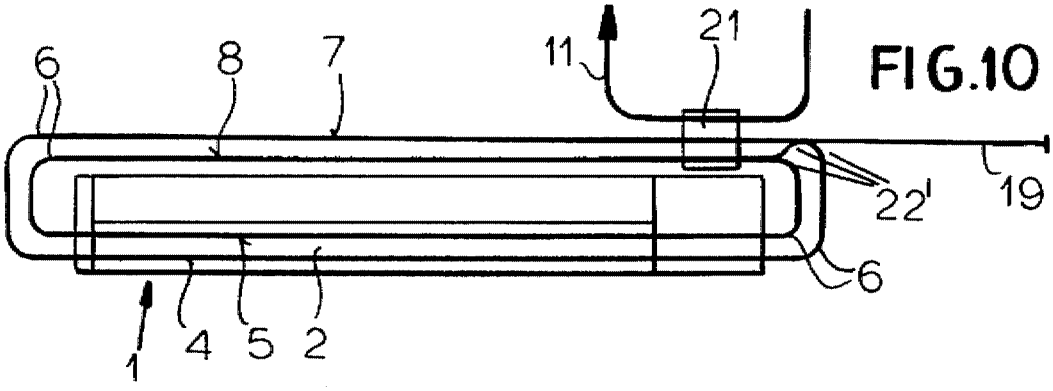
Figure 11:
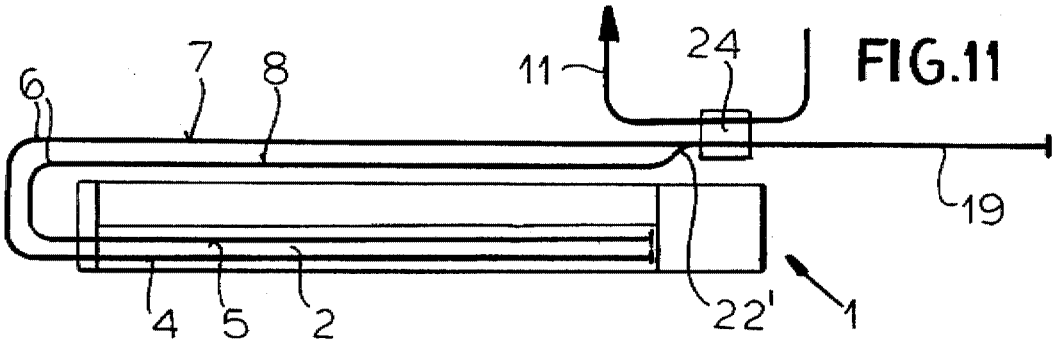

The three-row change-over device 21 is also used in the embodiment of FIG. 10 wherein the parking tracks 7, 8 can have a switch-over 22' to a single shuttle track 19. In this embodiment, the suspension carriage train from one of the parking tracks 7, 8 can be shuttled onto track 19 and back from the change over device 21 and the suspension carriage trains on the other of tracks 7, 8 is then fed onto the shuttle track 19 through the change-over device 21 to replace its full bobbins with core sleeves. The system of FIG. 10 requires less track. A further simplification has been illustrated in FIG. 11 where the switch track 22 is provided upstream of the change-over device 24 which here need only be a double-track unit. The suspension carriage trains from parking tracks 7 and 8 are successively passed through the change-over unit 24 and onto the shuttle track 19 and back from the latter. This type of operation is also possible in the embodiment of FIG. 10.

Figure 12:
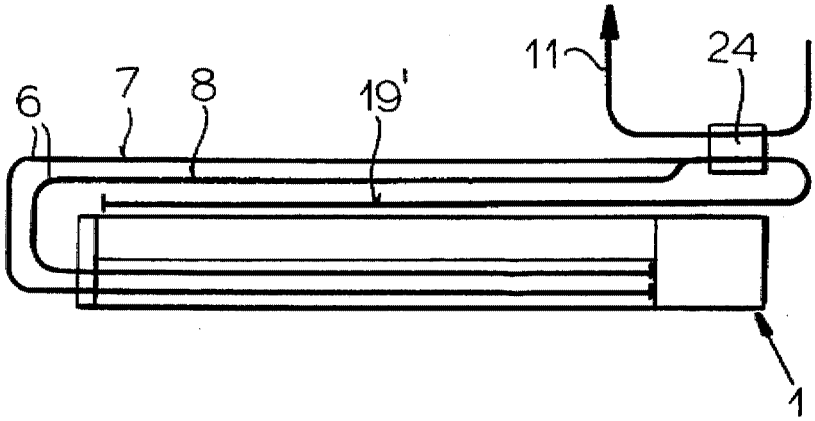

The shuttle tracks 19, 20 need not extend, as shown, linearly past the roving frame 1. Rather the shuttle track 19' can be bent back to extend primarily parallel to the tracks 7, 8 as has been illustrated in FIG. 12.

Figure 13:
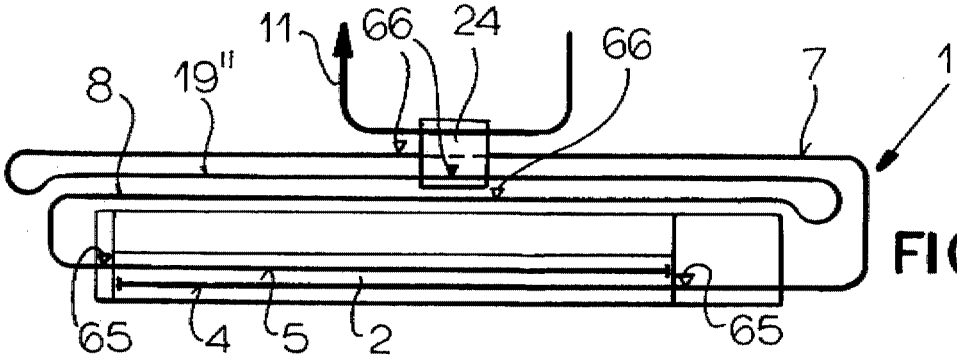

In the embodiment of FIG. 13, a folding of the shuttle track 19" is provided and in this case, the opposite ends of the shuttle tracks are connected to the parking tracks 7 and 8 via respective loops. The lengths of the suspension carriage trains can run from the free ends of the tracks 4, 5 (FIG. 13) to the locations marked at 65. The change-over station 24 is here located substantially intermediate of the lengths of the parking tracks 7, 8 and intermediate the length of the shuttle track 19". Points 66 represent ends of the trains after they have been displaced from the tracks 4, 5.

From the tracks 4, 5 the suspension carriage trains are displaced onto the respective parking tracks 7, 8. To replace the bobbins with core sleeves, the suspension carriage trains from the parking track 7 traverses the change-over unit 24 onto the shuttle track 19" and back. The suspension carriage train from parking track 8 traverses the change-over unit 24 onto the shuttle track 19" in the opposite direction and back. The lengths of the track sections in FIG. 13 are not necessarily to scale and it will be understood that the location of the change-over unit 24 can be varied to allow the parking track segments and the shuttle track segments to fully receive the suspension carriage train. The loops at the ends of the shuttle track 19" can be spaced apart or enlarged accordingly.

Figure 15:
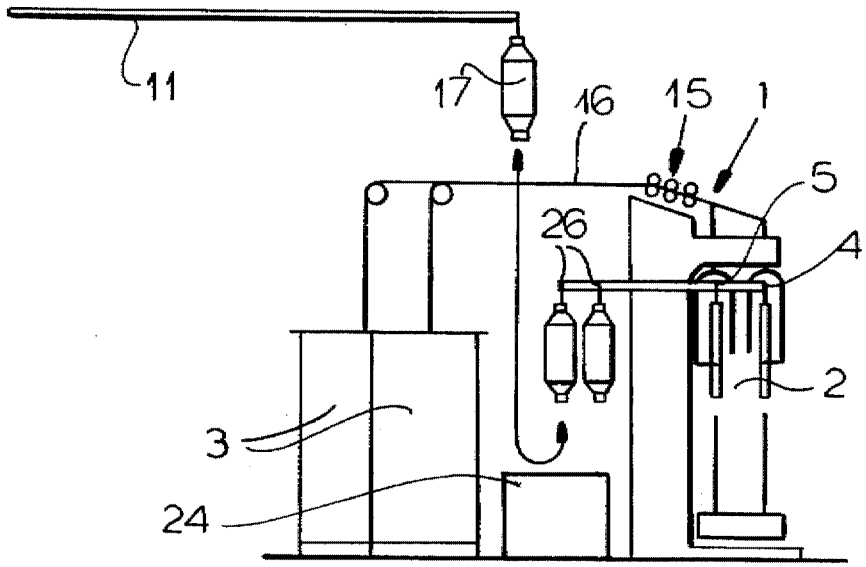
FIG. 15 is a view similar to FIG. 5 in accordance with another embodiment of the invention in which the can field is located to the rear of the roving frame.
Figure 14:
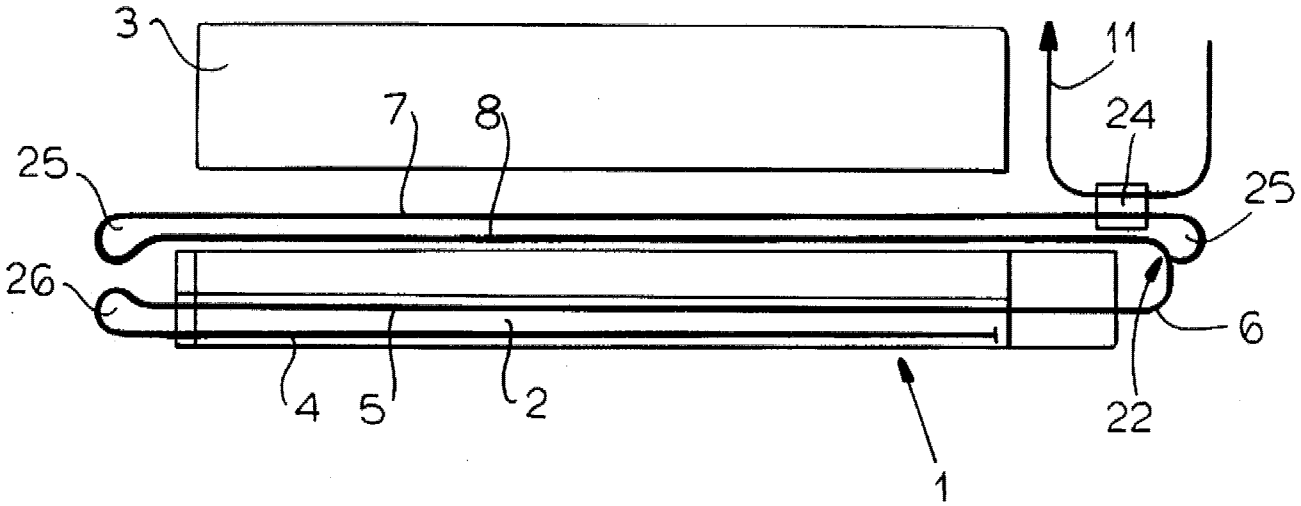

In FIG. 14 we have shown another advantageous variant of the system of the invention in which each of the two parking tracks 7, 8, is formed with a reverse loop 25 at its ends and the tracks 4 and 5 are connected by a loop 26 and can connect via a branching track 22 with the tracks 7, 8. Only one of the tracks 7, 8 need thus pass through the change-over unit 11. The tracks 7 and 8 form a closed loop. In this embodiment, the suspension carriage trains on the tracks 7 and 8 can be passed through the change-over unit 24 and via a branching track 22, can be returned to the tracks 4 and 5. No shuttle track is required in this case. Only one branch 22 is necessary although, since the parking tracks 7, 8 are in a closed loop connected with the tracks 4, 5, additional time is required to transfer the suspension carriage train from and to the track 4. Another advantage of this embodiment as well is that the change-over device 24 need accommodate only two tracks namely, the track 11 and the track 7 (see FIG. 15).

Figure 16:
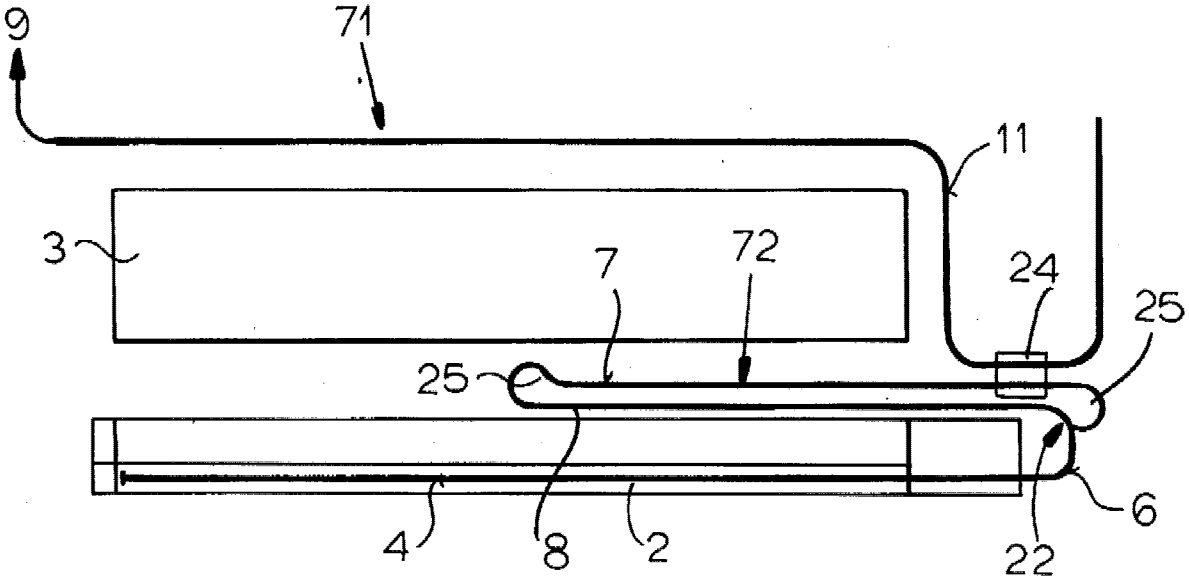
FIG. 16 is a view similar to FIG. 14 but representing another modification.

The application of the invention to a single flyer row roving machine 71 has been illustrated in FIG. 16 in which a closed loop 72 with the parking track segments 7, 8 and ends 25 is connected by a branch track 22 to the track 4 extending through the flyer row.

Figure 17:
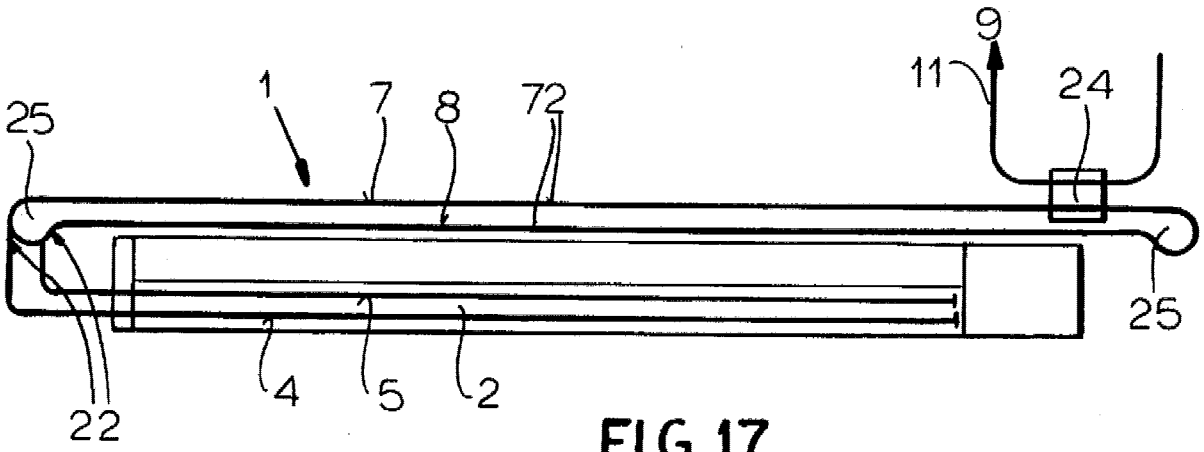
FIGS. 17–20, 21*a*, 21*b* and 21*c* are plan views of other track arrangements which can be used in accordance with the invention.
Figure 18:
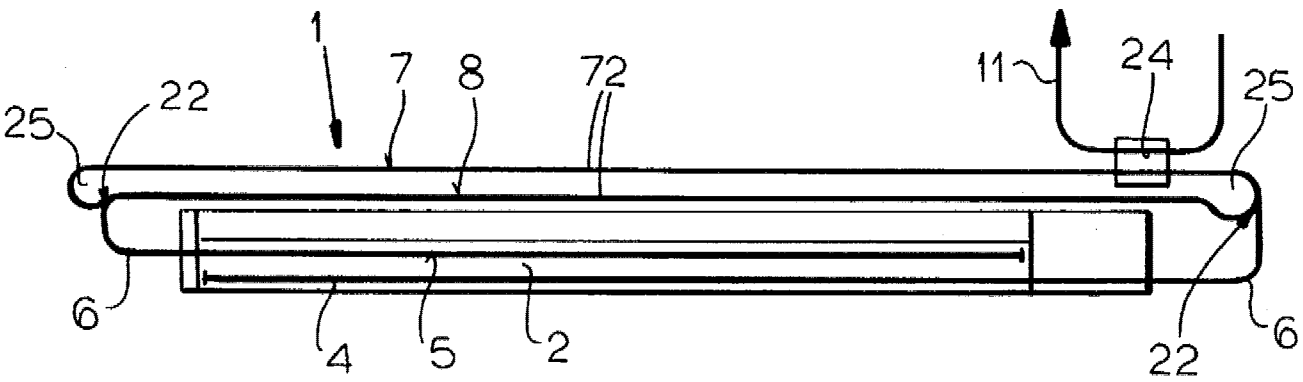

In FIG. 17 we show another system for connecting the suspension track segments 4 and 5 to the closed loop 72 with its parking track segments 7 and 8 and its end loops 25. In this case, the connection of the track segments 4 and 5 with the closed loop 72 is effected at one of the end loops 25 via two switch tracks 22. When, however, the suspension track segments 4, 5 operate in opposite directions, as can be seen from FIG. 18, each of the track segments 4 and 5 can be connected at a respective end loop 25 of the closed loop 72 via a respective switch track 22. The track segment 5 can thus send its suspension carriage train onto the parking section 8 while the track 4 sends its suspension carriage train onto the track 7 and passage of the suspension carriage train from track 8 to track 7 can be effected through the change-over unit 24.

Figure 19:
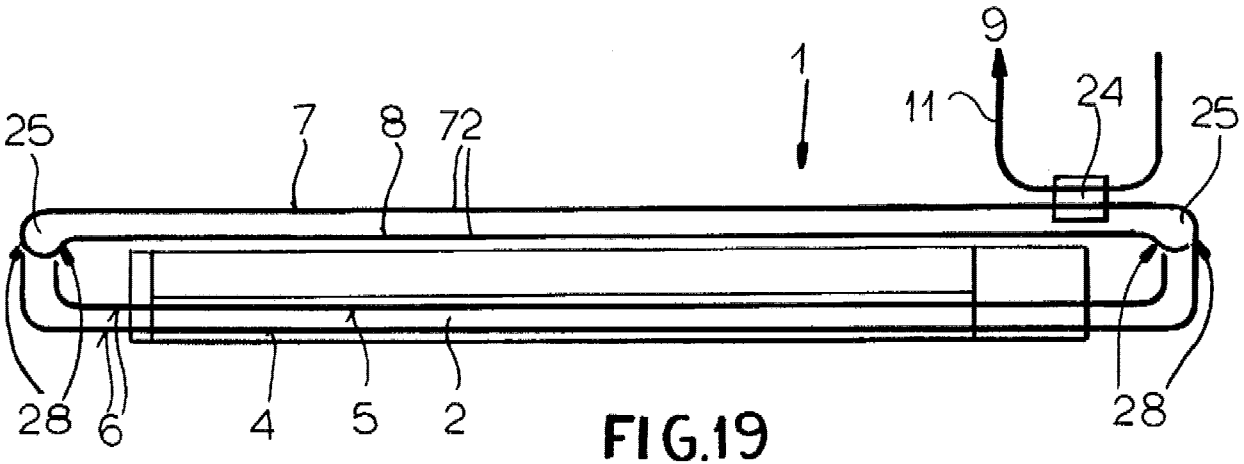

FIG. 19 shows an embodiment in which the turns 6 of the tracks 4, 5 are connected by switch tracks 28 to both ends of the closed loop 26, i.e. the end loops 25. This allows insertion of the suspension track segments into some or in opposite directions onto the parking track 7, 8 and also allows separation of the train on each of tracks 4 and 5 into halves with each half being shiftable in the direction opposite that of the other half to increase the speed of transfer. This arrangement, however, requires four switch tracks.

Figure 20:
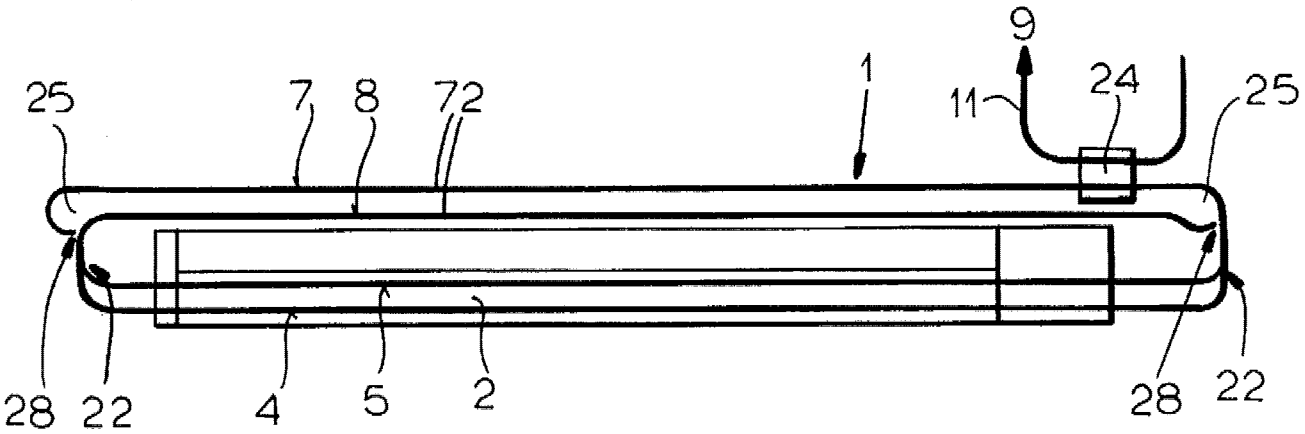

Four switch tracks are also required for the embodiment of FIG. 20 in which the tracks 4 and 5 are connected together at switches 22 at their ends and from the switches 22 switch tracks 28 connect the loop 72 to the switches 22.

The switch tracks are controllable conventionally although, to simplify the control system, spring-loaded tongue-type branches may be used which automatically return to normal positions and can be deflected into other positions by the travel of the respective train thereover.

Figure 21A:
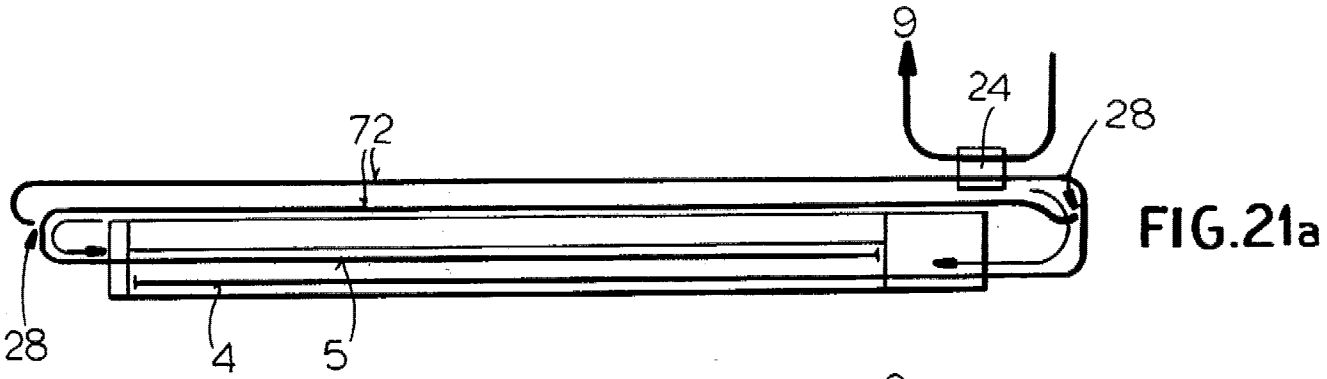
Figure 21B:
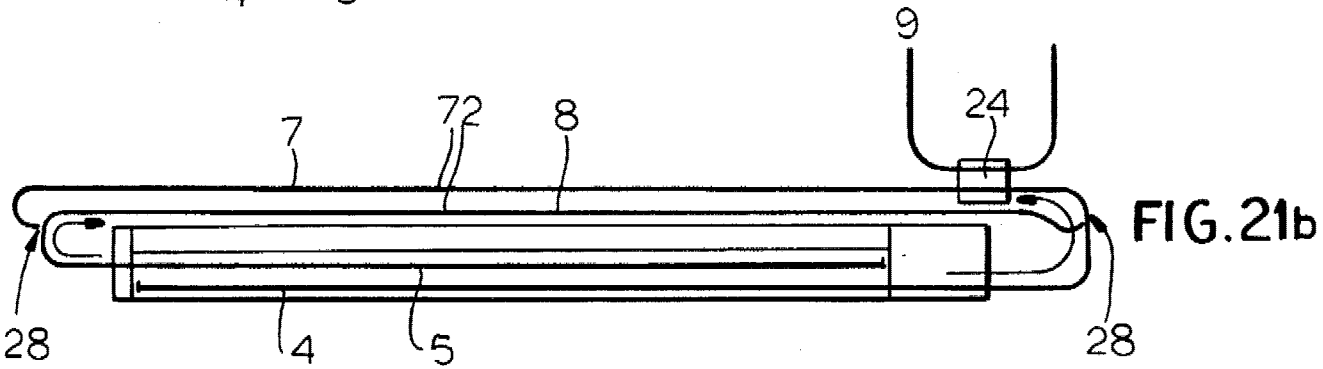
Figure 21C:
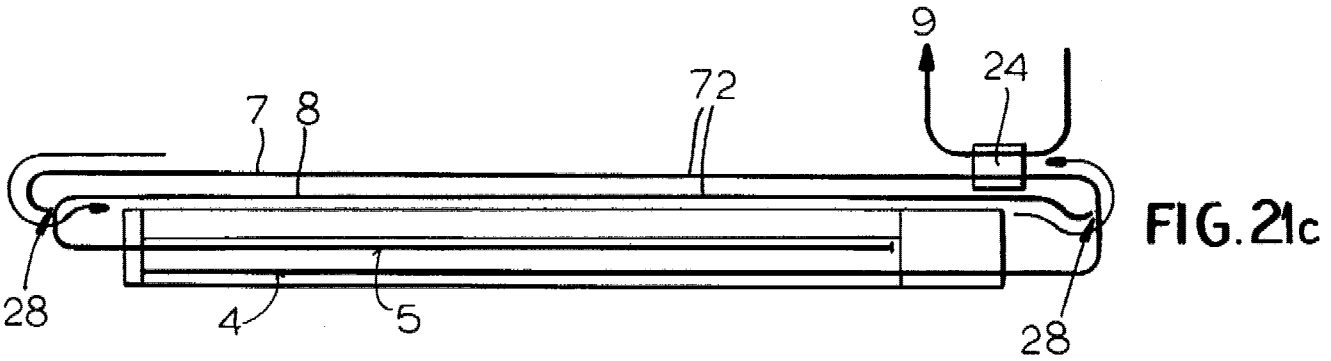

FIGS. 21*a*–21*c* illustrate the operation of a system utilizing switch tracks 28 at the end loops. The switch tracks 28 are so built into the end loops of the track loop 72 or are so spring-loaded that they guide the suspension carriage train into the tracks 4 and 5 from the loop 72. As can be seen from FIG. 21*a*, the suspension carriage train carrying empty bobbin sleeves is fed in the clockwise sense through the change-over device 24 onto the track 4 simultaneously with the displacement of the suspension carriage train previously provided with empty bobbins in the counterclockwise sense onto track 5. When the trains are fed in the opposite direction with the full bobbins, the suspension carriage train from track 4 passes through the change-over device 24 while the suspension carriage train from track 5 is deposited on the track 8 of the loop 72. Then the suspension carriage track on track 8 is fed onto track 7 of the loop 72 through the change-over device 24 (FIG. 21*c*).

The branches 28 in the latter operation are set to circulate the suspension carriage trains on the loop 72. The branches 28 may be noncontrollable branches in this embodiment and in the embodiments of FIGS. 19 and 20. In the embodiment of FIG. 20, however, only the two branches 28 at the ends 25 are noncontrollable.

We claim:

1. A bobbin and core sleeve transport system comprising:

a roving frame formed with a flyer region having at least one row of flyers;

a suspension carriage track extending through said row of flyers;

a suspension carriage train of a certain length displaceable along said suspension carriage track and provided with hangers receiving full bobbins from said roving frame and carrying empty core sleeves to said roving frame; and a parking track connected to said suspension carriage track at least at one end thereof so as to permit said suspension carriage train to travel from said suspension carriage track directly onto said parking track, said parking track being of a length sufficient to accommodate a full length of said suspension carriage train, and terminating at said roving frame so as to be incapable of directly delivering bobbins to a spinning frame or directly receiving empty core sleeves from a spinning frame, said parking track extending alongside said roving frame.

2. The bobbin and core sleeve transport system defined in claim 1, further comprising:

a transport track from which said full bobbins and empty core sleeves are suspended and having a track segment proximal to said parking track;

a bobbin/sleeve exchange station bridging between said parking track and said transport track and constructed and arranged to transfer full bobbins from said suspension carriage train while parked on said parking track to said transport track and empty core sleeves from said transport track to said suspension carriage train parked on said parking track; and means spaced from said roving frame and to which said transport track extends for receiving full bobbins from said transport track.

3. The bobbin and core sleeve transport system defined in claim 2 wherein said station comprises means for displacing said station on a path of travel parallel to said parking track.

4. The bobbin and core sleeve transport system defined in claim 3 wherein said segment is parallel to said parking track and extends therealong for said full length of said suspension carriage train.

5. The bobbin and core sleeve transport system defined in claim 2 wherein said roving frame is provided with two rows of flyers in said region, each of said rows of flyers having a respective suspension carriage track.

6. The bobbin and core sleeve transport system defined in claim 5 wherein each of said suspension carriage tracks is provided with a respective parking track connected with the respective suspension carriage track at an end thereof.

7. The bobbin and core sleeve transport system defined in claim 6 wherein said suspension carriage tracks and the respective parking tracks extend codirectionally along said roving frame.

8. The bobbin and core sleeve transport system defined in claim 6 wherein said suspension carriage tracks and the respective parking tracks extend oppositely away from one another along said roving frame.

9. The bobbin and core sleeve transport system defined in claim 6 wherein said suspension carriage tracks and the respective parking tracks form separate closed rings.

10. The bobbin and core sleeve transport system defined in claim 6 wherein said parking tracks are connected at opposite ends by curved track segments into a ring track.

11. The bobbin and core sleeve transport system defined in claim 10 wherein one of said suspension carriage tracks is connected to said ring track at one of said curved track segment by a branch track segment and the other of said suspension carriage tracks is connected to said ring track at the other curved track segment by another branch track segment.

12. The bobbin and core sleeve transport system defined in claim 11, wherein said branch track segments are provided with means for directing said suspension carriage train along the respective tracks.

13. The bobbin and core sleeve transport system defined in claim 2 wherein a can region is provided alongside said roving frame, sliver from cans in said can region being guided to said roving frame and entering said roving frame from above, said transport track being on the same side of said roving frame as said can region, said segment being located below the sliver passing from said cans to said roving frame.

14. The bobbin and core sleeve transport system defined in claim 2 wherein a can region is provided alongside a front of said roving frame, sliver from cans in said can region being guided to said roving frame and entering said roving frame from above, said transport track being located at a rear of said roving frame and said segment being at the same height as the remainder of said transport track.

15. The bobbin and core sleeve transport system defined in claim 2, further comprising a shuttle track connected to said parking track at a transition region, said station being fixed in position at said transition region.

16. The bobbin and core sleeve transport system defined in claim 15 wherein said roving frame is provided with two rows of flyers in said flyer region, each of said rows of flyers having a respective suspension carriage track, each of said suspension tracks being provided with a respective shuttle track for receiving a respective suspension carriage train from the respective parking track for exchange of full bobbins for empty core sleeves.

17. The bobbin and core sleeve transport system defined in claim 16 wherein the suspension carriage, parking and shuttle track of one row is separate from the suspension carriage, parking and shuttle track of the other row and said station has a multiplicity of track stretches extending through the station.

18. The bobbin and core sleeve transport system defined in claim 16 wherein the suspension carriage and parking track of one row form a ring separate from another ring formed by the suspension carriage and parking track of the other row, and said rings are connected to said shuttle track by a branch track segment and a cross-over segment.

19. The bobbin and core sleeve transport system defined in claim 15 wherein said roving frame is provided with two rows of flyers in said flyer region, each of said rows of flyers having a respective suspension carriage track, means being provided for shuttling suspension carriage trains from each of said parking tracks onto said shuttle track for exchange of full bobbins for empty core sleeves.

* * * * *